US005375746A

United States Patent [19]

Schaefer et al.

[11] Patent Number: 5,375,746

[45] Date of Patent: Dec. 27, 1994

[54] FOOD PUMP HAVING A CAST VALVE BODY

[75] Inventors: Robert E. Schaefer, Brookfield; Paul L. Rupar, Sussex, both of Wis.

[73] Assignee: Server Products, Inc., Wis.

[21] Appl. No.: 59,802

[22] Filed: May 10, 1993

[51] Int. Cl.[5] ..... B67D 5/42; B67D 5/50

[52] U.S. Cl. ..... 222/385; 222/383; 285/361; 285/396; 285/402

[58] Field of Search ..... 222/372, 380, 383, 385, 222/340; 137/512; 417/569, 571; 285/360, 361, 376, 396, 401, 402

[56] References Cited

U.S. PATENT DOCUMENTS

| | | | |
|---|---|---|---|
| 364,667 | 6/1887 | Parker | 222/385 |
| 480,068 | 8/1892 | Bullard | 222/385 |
| 662,980 | 12/1900 | Shepard | 222/385 |
| 682,191 | 9/1901 | Haslett | 239/139 |
| 1,698,632 | 1/1929 | Jaden | 222/385 |
| 2,022,208 | 11/1935 | Lacke | 222/385 |
| 2,204,838 | 6/1940 | Walstrom | 222/385 |
| 2,205,875 | 6/1940 | Coffey et al. | 222/385 |
| 2,485,526 | 10/1949 | Bennett | 164/259 |
| 2,639,063 | 5/1953 | Yuza | 222/385 |
| 2,662,256 | 12/1953 | Gagne | 222/385 |
| 2,743,959 | 5/1956 | Nelson et al. | 222/385 |
| 2,756,905 | 7/1956 | Wickesberg | 222/146.5 |
| 3,106,320 | 10/1963 | Campbell et al. | 222/318 |
| 3,332,585 | 7/1967 | Cox | 222/309 |
| 3,452,901 | 7/1969 | Roach | 222/49 |
| 3,729,022 | 4/1973 | Roach | 137/512 X |
| 4,869,404 | 9/1989 | Elliott | 222/385 |

FOREIGN PATENT DOCUMENTS

| | | | |
|---|---|---|---|
| 521442 | 3/1931 | Germany | 285/376 |

OTHER PUBLICATIONS

Server Syrup and Topping Pump, Server Products.
Englass FN 30.
The Fountain Pump, Server Products, Inc.
"Your Profitable Direction", Gold Metal, Catalog #48.
Stainless Steel Syrup Pumps, Chudnow Manufacturing Co. Inc., N.Y.
"Top O' The Line", Toppo Manufacturing Corp. Nevada.
Pumps, Lids and Containers, American Wyott Corporation, 1988.
Condiment and Syrup Pumps, Kenco Products Corporation, Catalog #1200.

*Primary Examiner*—Andres Kashnikow
*Assistant Examiner*—Lesley D. Morris
*Attorney, Agent, or Firm*—Andrus, Sceales, Starke & Sawall

[57] ABSTRACT

A hand operated piston displacement-type pump having a one-piece valve body retaining a removable cylinder and discharge tube, for dispensing prescribed portions of complex fluids, such as food products or liquids with suspended solids, at a desired point outside of a storage container. Valve ball control of the flow of the product is obtained with the combination of the precision channels in the valve body and in the bottom of the cylinder and discharge tube. The valve body includes structure necessary for seal and connection to allow the cylinder and discharge tube to be removed, without tools, for cleaning.

32 Claims, 3 Drawing Sheets

FOOD PUMP HAVING A CAST VALVE BODY

BACKGROUND OF THE INVENTION

Food pumps used in restaurants, fast food establishments, convenience stores, and the like to dispense liquid foods such as syrups and fudges for ice cream, condiments, sandwich toppings, dairy products, and other food products have to be readily cleaned.

Generally food product dispensing pumps have been piston displacement pumps made up of welded or brazed stainless steel assemblies housing one way valves each for intake and outlet. The outlet leads to a discharge tube that directs the flowing product through a lid to a point handy for application of the product.

The typical food pump as used in the past has several shortcomings. Multiple parts were often required to obtain proper valve action. Because sanitary conditions are required for components in contact with food products, brazing was often the method chosen to join the many components. Effects of brazing were found to introduce other problems, such as corrosion. Some cleaning chemicals further weaken brazed joints. Due to the viscosity of certain products, such as fudge topping, it is necessary to confine the movement of the floating valve balls. Formerly, the valve balls were restricted by various devices such as springs, pins, and cages. The devices used to limit valve ball movement often created straining and eventual clogging when used with food products containing chunks and strands, such as strawberries, beans, onions, and the like.

As the food pump handles food products, it is necessary to periodically clean the pump and in many instances, the typical pump is difficult to disassemble for cleaning purposes. Moreover, many food pumps contain loose springs, pins, valve retainers, valve cages and other small and intricate parts which are difficult to handle and thoroughly clean. In addition to a large number of intricate parts, the typical food pump, when disassembled, often has limited access to the lower end of the cylinder and/or discharge tube, making it difficult to thoroughly clean these tubes.

SUMMARY OF THE INVENTION

The invention is directed to an improved corrosion resistant portion dispensing food pump that can handle chunky materials and which can be readily disassembled and cleaned.

The food pump includes a cylinder which can be mounted in the lid of a container that contains the food product, and a piston with seal moves within the cylinder and provides fluid displacement. Attached to the piston is a piston rod which projects outwardly of the upper end of the cylinder and carries a hand knob. The piston and piston rod are biased to an upper position by a spring.

Also mounted within an opening in the lid of the container, at a point away from and often at a different angle from the cylinder axis, is a discharge tube, and the lower ends of the cylinder and the discharge tube are interconnected by a cast valve body formed of metal or plastic.

The valve body is divided into two defined sections, the inlet body section and outlet body section. The inlet body section defines an inlet valve ball chamber having an inlet opening at its lower end, and a valve ball is mounted for movement in the inlet ball chamber and serves to open and close the inlet.

The inlet body section also includes a flow chamber which is located laterally of the inlet ball chamber and communicates with the inlet ball chamber through an aperture having a smaller dimension than the diameter of the valve ball so that the valve ball will be retained within the inlet ball chamber. The upper end of the flow chamber communicates with the lower end of the cylinder and is bordered by a pair of generally sloping transition surfaces which facilitate flow of the food product into the cylinder on intake and back into the flow chamber on discharge.

The valve body also includes an outlet body section defining an outlet ball chamber, the lower end of which communicates with the flow chamber of the inlet body section through a connecting passage, and the lower end of the outlet ball chamber defines a valve seat which is opened and closed by a second or outlet valve ball. Located laterally of the outlet ball chamber is a second flow chamber which communicates with the outlet ball chamber through a second aperture. Again, the second aperture has a dimension smaller than the diameter of the outlet valve ball so that the outlet valve ball will be retained within the outlet ball chamber. The upper end of the flow chamber is connected to the discharge tube With this construction, a relatively large flow path for the liquid food is provided through the valve body. The valve balls, when in the open position, do not restrict the flow channels so that the pump can be used to pump food products containing chunky materials.

As a feature of the invention, the valve body containing the inlet body section and the outlet body section, is connected to the cylinder and to the discharge tube, respectively, through bayonet-type connections. By rotating the cylinder and the discharge tube through a relatively small arc, the valve body can be attached to both the cylinder and the discharge tube.

As a further feature of the invention, the construction used to provide ball control yet obtain optimum flow is the provision of a separate chamber for vertical valve ball movement and an adjacent chamber for product flow. Vertical limit to ball movement is obtained by an offset cylinder flange on the intake side and by the bottom of a bushing on the discharge tube on the outlet side.

A benefit of having both valves parallel in the same removable component is that when both the cylinder and discharge tube are removed, oriented as used, both balls are retained in the valve body until it is purposely inverted, thereby preventing accidental loss of the balls. Furthermore, the interior of the valve body is accessible when the balls are removed so that the valve seats can be precision machined with the same tool and can be readily cleaned.

With the invention, a one-piece valve body houses both the valve balls, which are gravity biased to the closed position, thus eliminating the need for springs or other biasing mechanisms which are difficult to disassemble and clean.

By connecting the valve body to the cylinder and to the discharge tube by the bayonet-type connections the need for auxiliary connectors or fasteners is eliminated and no special tools are required for disassembly. As no screw threads are present in the valve body, cleaning is facilitated.

Removal of the valve body, not only provides access to the interior of the valve body for ease of cleaning, but also provides access to the lower ends of the cylinder and discharge tube so that these members can be readily cleaned by inserting a brush from either end of the tubes.

By utilizing an investment cast process, a one-piece valve body can be formed of stainless steel maintaining tolerance and finish with a minimum amount of machining.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
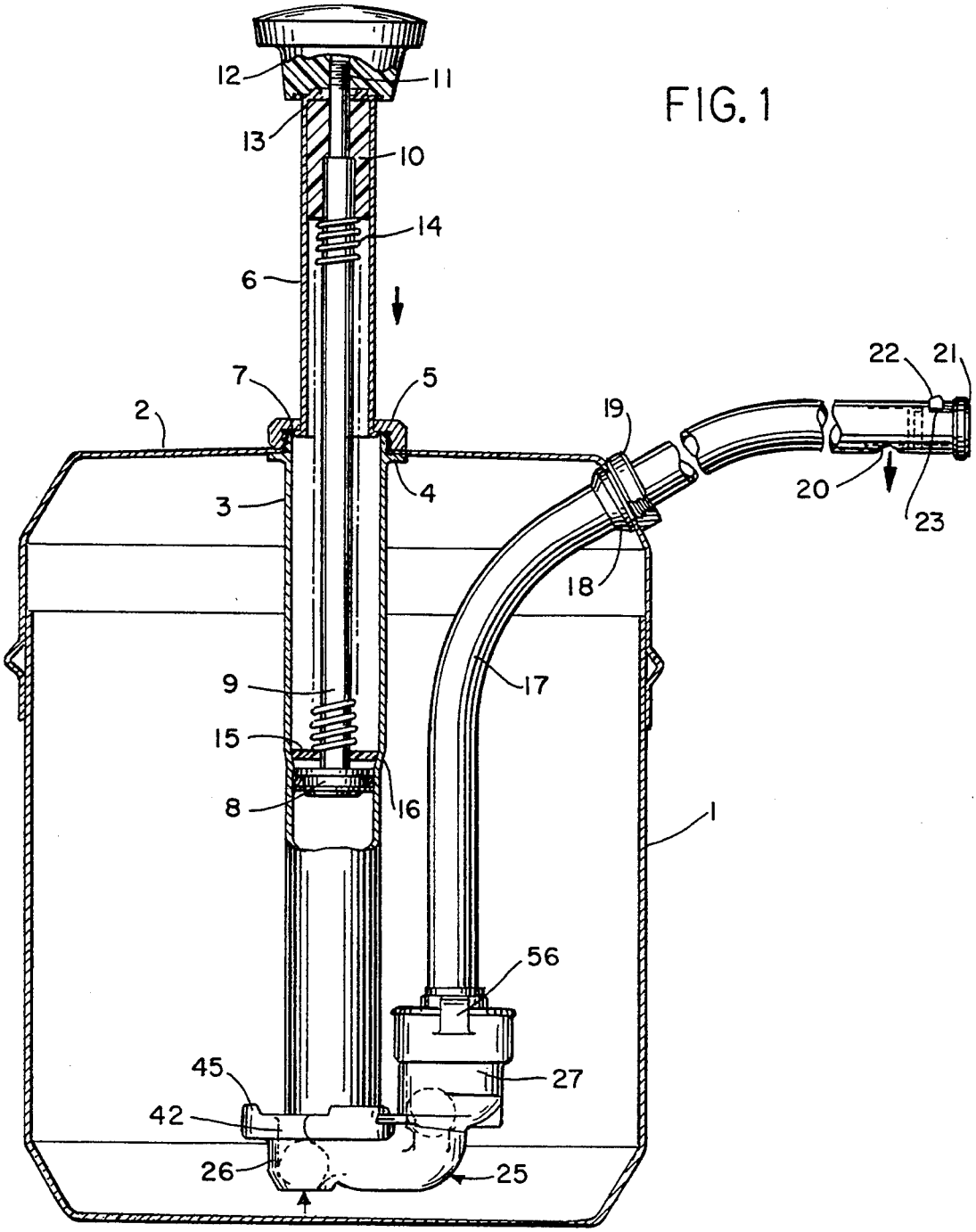
FIG. 1 is a vertical section of the food pump of the invention.

The drawings illustrate an improved pump for dispensing controlled portions of liquid food products. The improvements relate to ease of disassembly for cleaning, potential to be produced of corrosion resistant material, and a design for improved flow enabling foods to be dispensed with larger particles and strands that would have restricted flow or effected the dispensed quantity in prior art pumps.

The best mode utilizes the pump immersed in dispensable product within a container 1 covered by a non-sealed pump supporting lid 2.

A cylinder 3 is mounted within an opening in lid 2 and in this regard, the upper end of the cylinder is provided with an outwardly extending flange 4 which bears against the under surface of the lid, while a collar 5 is threaded on the upper end of the cylinder and bears against the outer surface of the lid. By threading down collar 5, lid 2 will be tightly captured between flange 4 and the collar.

Extending upwardly from cylinder 3 is a head tube 6 and the lower end of the head tube is provided with an outwardly extending flange 7 which is located within the collar 5 as shown in FIG. 1. Thus tightening down collar 5 will also limit movement of head tube 6 to the top of cylinder 3. A hole in collar 5 serves as a guide and travel limit for head tube 6.

Mounted for sliding movement in cylinder 3 is a piston 8 and a piston rod 9, is connected to the piston and extends upwardly through the cylinder and through head tube 6. The upper end of piston rod 9 is received within an opening in a cylindrical insert 10 that is mounted within the upper end of head tube 6. The upper end 11 of the piston rod 9 is threaded and is connected to a hand knob 12. An 0-ring 13, to provide a sanitary seal and knob retention, is mounted within a groove in the lower end of the hand knob 12 and bears against the upper end of the head tube 6.

Piston 8 and piston rod 9 with head tube 6 are biased to an upper position by a coil spring 14 which is located within cylinder 3 and head tube 6. As shown in FIG. 1, the lower end of spring 14 bears against a washer 15 which is mounted against the internal shoulder 16 in cylinder 3, while the upper end of the spring bears against the lower end of insert 10. With this construction, the force of the spring 14 will bias the piston 8, piston rod 9, and head tube 6, and knob 12 upwardly to the position shown in FIG. 1.

Also mounted within an opening in lid 2 is a generally curved discharge tube 17. The flange of a ferrule 18 is welded to the central portion of discharge tube 17 and bears against the inner surface of lid 2, while a collar 19 is threaded onto an extension of the ferrule against the outer surface of the lid, thereby securing the discharge tube 17 to lid 2.

As shown in FIG. 1, a hole 20 is formed in the lower surface of the discharge tube adjacent its outer or distal end and the outer end of the tube can be enclosed by a cap 21. Cap 21 is provided with an outwardly extending pin 22 which is adapted to be engaged with an L-shaped notch 23 formed in the end of tube 17 to thereby retain the cap within the end of the tube.

Figure 4:
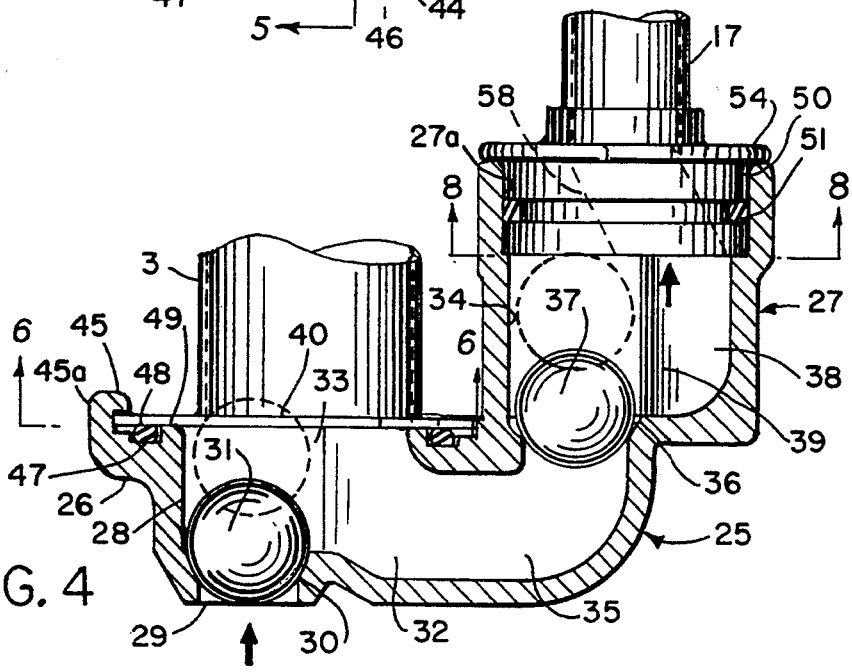
FIG. 4 is the section taken along line 4—4 of FIG. 3.
Figure 5:
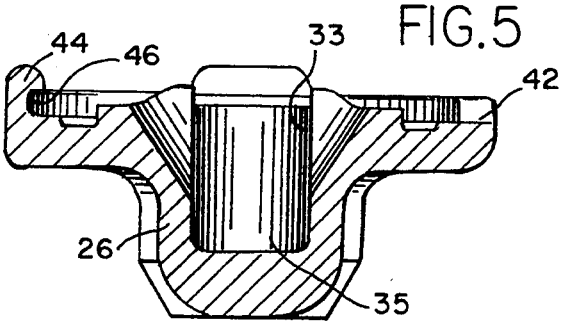
FIG. 5 is a section taken along line 5—5 of FIG. 3.
Figure 7:
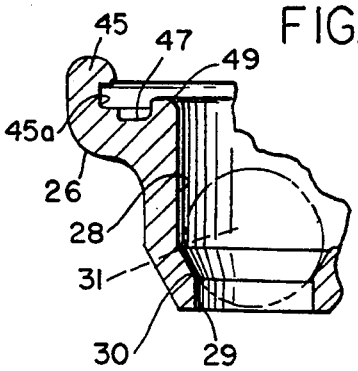
FIG. 7 is a section taken along line 7—7 of FIG. 3.

A cast valve body 25 preferably composed of plastic interconnects the lower ends of cylinder 3 and discharge tube 17. As best seen in FIG. 4, valve body 25 includes an inlet body section 26 and an outlet body section 27. Inlet section 26 is formed with an inlet ball chamber 28 which is generally cylindrical in configuration and the lower end of chamber 28 has an inlet opening 29 through which the liquid food is drawn into the valve body. The lower portion of chamber 28 defines an annular valve seat 30 which supports a valve ball 31, preferably formed of stainless steel.

Located laterally of inlet ball chamber 28 is a flow chamber 32 and an aperture or opening 33 that interconnects the chambers 28 and 32. Aperture 33 extends substantially the full height of chamber 28 and the horizontal width of aperture 33 is less than the diameter of the valve ball 31 so that it will be retained in the ball chamber 28.

Figure 2:
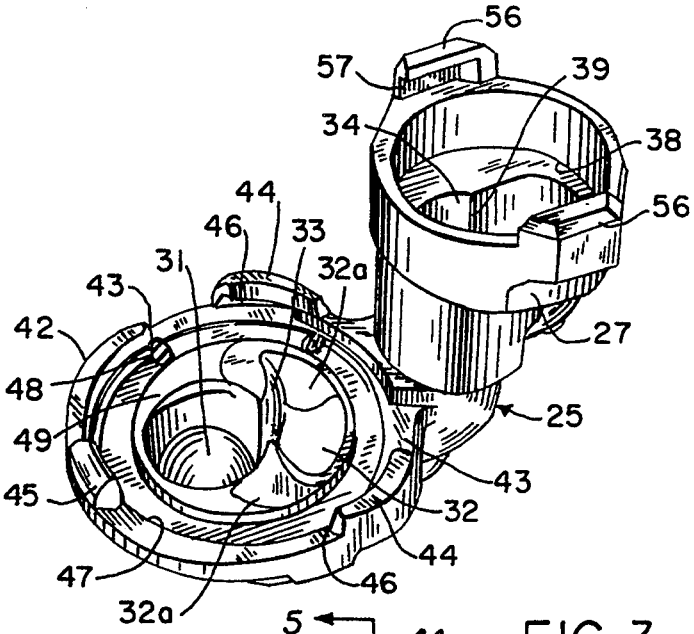
FIG. 2 is a perspective view of the valve body casting.

Located at the upper end of flow chamber 32 is a pair of transition surfaces 32*a*. As best seen in FIG. 2, surfaces 32*a* are positioned on either side of flow chamber 32 and slope upwardly toward the lower end of cylinder 3. Transition surfaces 32*a* facilitate the flow of the food from flow chamber 32 to cylinder 3 on intake, and also facilitate the flow from cylinder 3 into flow chamber 32 and then through connecting passage 35 to the outlet body section to discharge tube 17 on discharge.

Outlet body section 27 includes a generally cylindrical outlet ball chamber 34 and the lower end of ball chamber 34 is connected to flow chamber 32 via a connecting passage 35, as shown in FIG. 4. The lower end of outlet ball chamber 34 defines an annular valve seat 36 which is a section of a 60° cone forming an annular surface and supports an outlet valve ball 37. Located laterally of the ball chamber 34 is a flow chamber 38 and the flow chamber 38 communicates with chamber 34 via an aperture or opening 39. The horizontal width of the aperture 39 is less than the diameter of the valve ball 37 so that the valve ball will be retained within the ball chamber 34. In practice, valve balls 31 and 37 may be about one-half inch in diameter.

Figure 3:
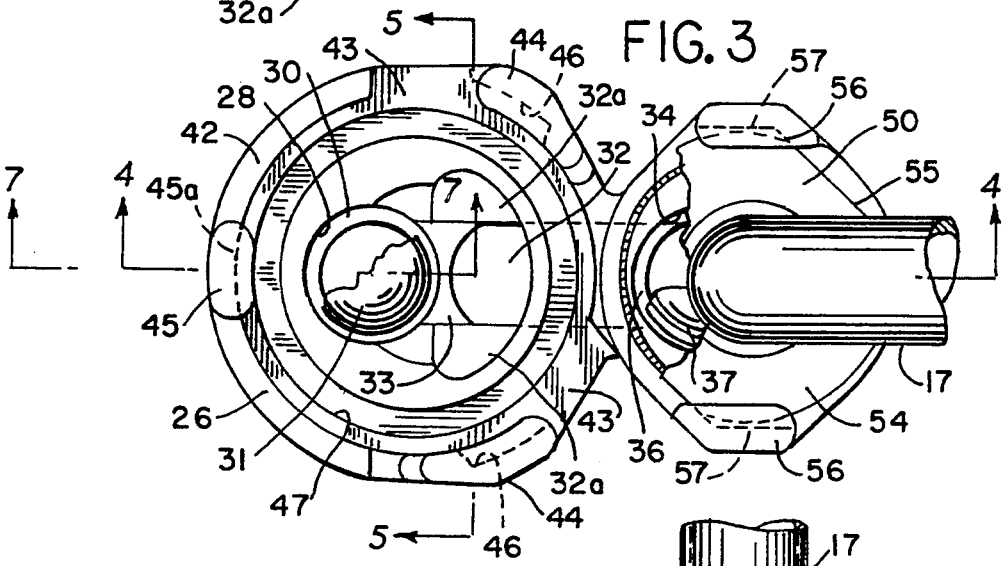
FIG. 3 is a top plan view of the casting with parts broken away.
Figure 6:
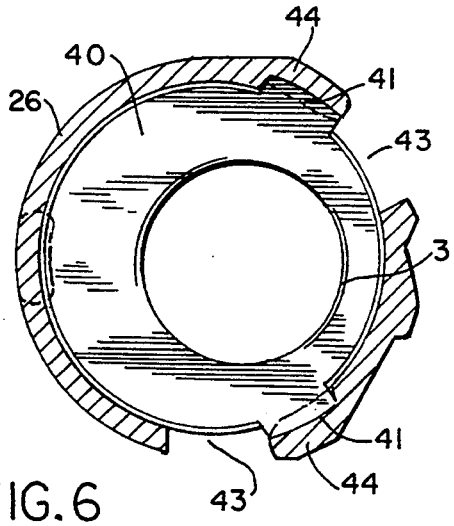
FIG. 6 is a section taken along line 6—6 of FIG. 4 and showing the offset flange on the cylinder.
Figure 8:
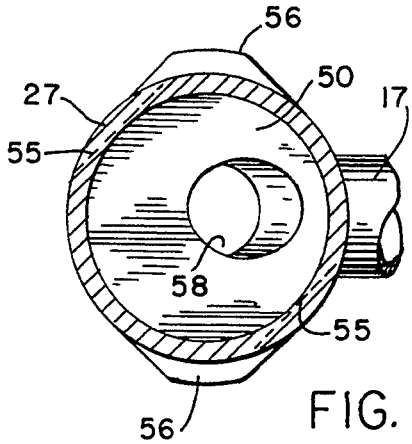
FIG. 8 is a section taken along line 8—8 of FIG. 4 and showing the offset opening in the cap on the lower end of the discharge tube.

Both the cylinder 3 and the discharge tube 17 are connected to the valve body through bayonet connections and 0-ring seals. The bayonet connection for the lower end of cylinder 3 is comprised of an outwardly extending flange 40 on cylinder 3 and a pair of tabs 41 project outwardly to form circumferentially spaced locations on flange 40, as shown in FIG. 6. The upper edge of valve body section 26 is provided with a peripheral upstanding piloting rim 42 having a pair of gaps 43 which are of sufficient circumferential dimension to receive tabs 41. A pair of undercut projections 44 project upwardly from rim 42 and are located adjacent the gaps 43. In addition, an undercut projection 45 extends upwardly from rim 42 and is spaced from both of the projections 44, as best seen in FIGS. 2 and 3. Projections 44 and 45 define inwardly facing guide channels or grooves 46 and 45*a*. The grooves 46 in projections 44 receive the tabs 41 on cylinder 3 as the cylinder is rotated relative to the valve body 25.

To seal the valve body to the lower end of cylinder 3, the upper surface of valve body section 26 is formed with a circular groove 47 which receives an 0-ring 48. The lower surface of flange 40 of cylinder 3 acts as a seal surface to 0-ring 48 in groove 47.

To attach cylinder 3 to valve body 25, cylinder 3 is canted to slip the larger portion of flange 40 into groove 45*a* of projection 45, then leverage is used on cylinder 3 to apply pressure to 0-ring 48 until tabs 41 can enter grooves 46 in projections 44 with a rotation of the cylinder 3 to fully engage grooves 46. The relationship between top surface of grooves 46 and 45*a* to the bottom surface of the 0-ring groove 47 is necessary to provide uniform compression of 0-ring 48. Surface 49 provides a limit to carry mechanical loading and prevent over compression of the 0-ring. The shape of flange 40 enables tabs 41 to be cut from a formed concentric flange, utilizing material that would otherwise be discarded if only eccentric. Further, flange 40 is formed integrally with cylinder 3, thus eliminating a joining process.

Discharge tube 17 includes a discharge bushing 50 which carries an 0-ring seal 51 within a groove of precise depth, so that when bushing 50 is slid into the bore 27*a* the 0-ring seal 51 is properly compressed to form a seal. Discharge tube 17 is kept from rotating once attached to lid 2 because the axis of collar 19 is significantly different in angle and/or position than bore 27*a* of valve body 25.

To connect the discharge bushing 50 of discharge tube 17 to the valve body 25, a flange 54 extends outwardly from the upper edge of discharge bushing 50 and flange 54 is provided with a pair of opposed flats 55, as shown in FIG. 3 to provide clearance for projections 56. The upper edge or rim of valve body section 27 is formed with a pair of opposed undercut projections 56 each of which defines an inwardly facing groove or channel 57. To install discharge tube 17, the bushing 50 is aligned so opposed flats 55 clear both projections 56 then the bushing 50 is inserted within the bore 27*a* of valve body section 27. Through rotation of the discharge tube 17, the flange 54 will be rotated into the channels 57 in the projections 56 to provide a locking connection between the discharge tube 17 and the valve body 25.

The bushing 50 is formed with a diagonal hole 58, the lower end of which is offset from the axis of the bushing and is located above chamber 38, as seen in FIG. 4. Diagonal hole 58 can be replaced by a longitudinal hole aligned with flow passage 38. With a smaller hole, the flow passage can be concentric with bushing 50.

To dispense the food from container 1, the knob 12 is depressed moving the piston 8 and hence increasing the pressure within cylinder 3 and unseating the discharge valve ball 37 to permit the air to be vented through the discharge tube 17. On the subsequent upward stroke of the piston 8, a partial vacuum will be created in the cylinder 3 thereby unseating the inlet valve ball 31 to permit the liquid food to enter the valve body 25 through inlet 29. The food is drawn upwardly through flow chamber 32 and across the transition surfaces 32*a* to the cylinder. On the next down-stroke of the piston 8, the pressure applied to the food within the cylinder will seat the inlet valve ball 31 and the pressure differential will unseat the outlet valve ball 37 to permit the food to be discharged from cylinder 3, across transition surfaces 32*a* to flow chamber 32, and then through transfer passage 35, past the open valve ball 37 to flow chamber 38 and then through hole 58 in bushing 50 to discharge tube 17.

With the invention, a one-piece valve body 25 houses both the inlet and outlet valves. The valve body is designed so that when the valves are in the open position relatively large flow channels are provided for the food product so that the pump is capable of dispensing foods containing chunky materials. More specifically, on intake stroke, ball 31 rises in ball chamber 28, while the food product flows under the ball through the aperture 33 into the flow passage 32 and into cylinder bore. Upon downward stroke of the piston, flow is again through flow chamber 32 taking a change in direction into the transfer passage 35, traveling horizontally until again changing direction through a controlled bend to the back side of the valve seat 36 lifting the outlet valve ball 37 confined in the ball chamber 34. The product then flows through the aperture 39 into the flow passage 38 and into the discharge bushing 50 of the discharge tube 17 and then through the tube to the point of discharge.

Flange 40 is located eccentrically of cylinder 3, as shown in FIG. 6. When the cylinder is connected to the valve body through the bayonet connection, a portion of the flange 40 will be located above the inlet ball chamber 28, thus serving as a third point of contact to limit upward movement of the valve ball 31. As a feature of the invention, the offset relation of flange 40 on cylinder 3 enables the flange to function as a stop to limit upward movement of ball valve 31. Similarly the offset relation of opening 58 in discharge bushing 50 permits the lower surface of the discharge bushing to serve as a stop to limit upward movement of ball valve 37. Thus, the invention eliminates the need for separate or auxiliary valve stops or cages.

The bayonet connections between the valve body 25 and cylinder 3 and discharge tube 17 enable the pump to be readily assembled and disassembled for cleaning. When the discharge tube 17 and cylinder are removed from the valve body 25, full access to the valve body is provided for ease of cleaning. Further, access is also provided to the lower ends of both the cylinder 3 and discharge tube 17 so that these members can be cleaned by running a brush into either open end of the tubes. Further, no separate fasteners or connecters, such as screws or bolts, are required to connect the cylinder 3 or tube 17 to the valve body.

The one-piece valve body 25 with many integral features houses the two floating valve balls 31 and 37, locates the 0-ring seal 48, provides a precise seal surface, provides valve ball control, provides a transfer passage, and provides attachment means for cylinder and discharge tubes. Thus, the section of the pump containing the valves is composed of a minimum number of parts yet providing many functions previously provided by numerous separate parts, i.e. springs, valve cages, permanently joined components, and detachable parts to provide the necessary functions.

Investment casting is the preferred manner of producing the valve body 25, and this enables the shape and sanitary finish of the inner passageways to be controlled with a minimum amount of machining. The investment cast process also helps hold important dimensional relationships between the three retention surfaces 45*a* and 46 and the bottom of the 0-ring groove 47.

Figure 9:
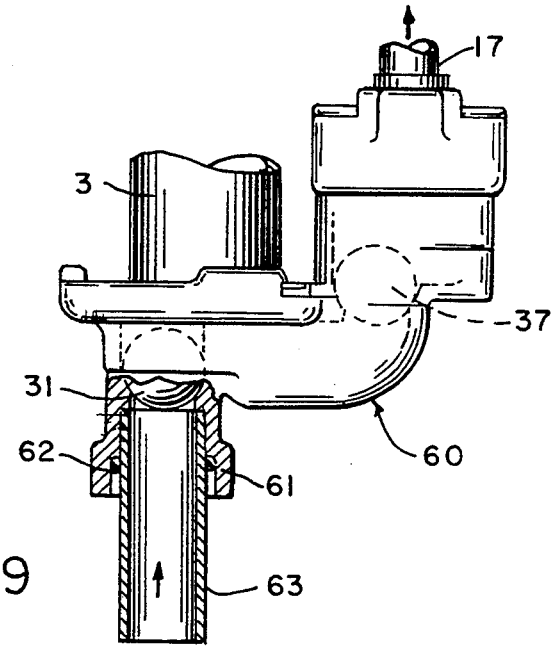
FIG. 9 is a side elevation, with parts broken away, of a modified form of the invention.

FIG. 9 shows a modified form of the valve body enabling connection to a remote container, such as bag-in-box or pouch and for applications where the pump is not as long as the container is deep. The valve body casting 60 is different from valve body 25 only in the downward extending annular flange 61 into which an 0-ring 62 is inserted prior to insertion of extension tube 63. 0-ring 62 is retained without the conventional groove since there is only pressure differential or negative pressure toward the side supported. The extension tube 62 can be of any desired length so that the lower end of the tube will be located adjacent the bottom of the container.

Various modes of carrying out the invention are contemplated as being within the scope of the following claims particularly pointing out and distinctly claiming the subject matter which is regarded as the invention.

We claim:

1. A food pump comprising: pump means including a cylinder and a piston mounted for movement in said cylinder, said cylinder having an open lower end, a discharge tube, a valve body interconnecting the lower end of the cylinder and the lower end of the discharge tube, said valve body including an inlet body section defining an inlet ball chamber communicating with the lower end of said cylinder and having an inlet, said inlet being disposed in the lower end of said inlet body section, said inlet body section having a first annular valve seat bordering said inlet, said inlet ball chamber being generally cylindrical and extending upwardly from said valve seat, said inlet body section also defining a first flow chamber disposed laterally of said inlet ball chamber, first aperture means connecting said inlet ball chamber with said first flow chamber, a first valve ball disposed in said inlet ball chamber and mounted to open and close said inlet, said valve body including an outlet body section defining an outlet ball chamber communicating with the lower end of said discharge tube, said valve body also including a passage connecting said first flow chamber with said outlet ball chamber, a second ball valve mounted for movement in said outlet ball chamber and disposed to open and close said passage, first connection means interconnecting the upper end of said inlet body section to the lower end of said cylinder, and second connection means interconnecting the upper end of said outlet body section to the lower end of said discharge tube.

2. The pump of claim 1, wherein said outlet body section includes a second inlet in the lower end thereof communicating with said passage, said outlet body section also includes an annular second valve seat bordering said second inlet, said second valve ball disposed to engage said second valve seat.

3. The pump of claim 2, wherein said outlet ball chamber is generally cylindrical in configuration and extends upwardly from said second valve seat, said outlet body section also defining a second flow chamber disposed laterally of said outlet ball chamber and communicating with the lower end of said discharge tube, and second aperture means interconnecting said outlet ball chamber and said second flow chamber.

4. The pump of claim 3, wherein said second connection means comprises a plurality of circumferentially spaced upwardly extending projections on the upper edge of said outlet valve section, said projections having inwardly facing channels, and a flange on the lower end of said discharge tube and disposed to be rotated into engagement with the channels on said projections.

5. The pump of claim 4, and including a discharge bushing connected to the lower end of said discharge tube and disposed in the upper end of said outlet body section, said discharge bushing having an opening providing communication between the discharge tube and the second flow chamber, and sealing means for sealing the discharge bushing in the upper end of said outlet body section.

6. The pump of claim 5, wherein said opening extends diagonally of the axis of said discharge bushing and the lower end of said opening registers with the upper end of said second flow chamber.

7. The pump of claim 3, wherein the horizontal width of said second aperture means is less than the diameter of said second valve ball.

8. The pump of claim 1, wherein the horizontal width of said first aperture means is less than the diameter of said first valve ball.

9. The pump of claim 1, and including at least one sloping transition surface interconnecting the upper end of said first flow chamber and the lower end of the cylinder.

10. The pump of claim 1, wherein said valve body is composed of a metal casting.

11. The pump of claim 1, wherein said valve body is composed of plastic.

12. The pump of claim 1, wherein said first connection means comprises a radially extending flange disposed on the lower end of said cylinder, a plurality of circumferentially spaced first tabs extending radially outward from said flange, the upper end of said inlet body section including a plurality of circumferentially spaced inwardly facing first channels to receive said first tabs with spaces between said first channels being of sufficient circumferential dimension to receive said first tabs in a release position, the upper end of said inlet body section also having a second inwardly facing channel spaced circumferentially from said first channels and disposed to receive a portion of said flange, an annular compressible seal disposed between the flange and the upper end of said inlet body section, whereby canting of said cylinder to effect engagement of said flange with said second channel and downward leverage applied through said cylinder will compress said seal and subsequent rotation of said cylinder will move said first tabs into a locking position with said first channels to provide sealed connection between said cylinder and said valve body.

13. The pump of claim 1, and including a radially extending flange on the lower end of said cylinder, said first connecting means connecting said flange to said inlet body section, the axis of said cylinder being offset from the axis of said inlet ball chamber and a portion of said flange extending across the upper end of said inlet ball chamber to limit upward movement of said first valve ball.

14. The pump of claim 1, wherein said inlet and outlet ball chambers are generally cylindrical in configuration and the axes of said inlet and outlet ball chambers are parallel.

15. A food pump comprising: pump means including a cylinder and a piston mounted for movement in said cylinder, said cylinder having an open lower end, a discharge tube having an open lower end, a valve body interconnecting the lower end of the cylinder and the lower end of the discharge tube, said valve body including an inlet body section defining an inlet ball chamber and having an inlet, a first valve ball disposed in said inlet ball chamber and mounted to open and close said inlet, said inlet body section also defining a first flow chamber disposed laterally of said inlet ball chamber and communicating with the lower end of said cylinder, said inlet body section also having a first aperture connecting said inlet ball chamber with said first flow chamber, said valve body also including an outlet body section defining an outlet ball chamber, said valve body also including a passage connecting said first flow chamber to said outlet ball chamber, a second valve ball mounted for movement in said outlet ball chamber and disposed to open and close said passage, said outlet body section also having a second flow chamber disposed laterally of said outlet ball chamber and communicating with the lower end of said discharge tube, a second aperture interconnecting said outlet ball chamber and said second flow chamber, and connecting means for connecting said valve body to the lower end of said cylinder and to the lower end of said discharge tube.

16. The pump of claim 15, wherein said inlet and outlet ball chambers are generally cylindrical in shape and the horizontal dimension of each aperture is less than the diameter of the corresponding valve ball.

17. The pump of claim 16, wherein each aperture extends substantially the full length of the respective ball chamber.

18. The pump of claim 15, and including a pair of sloping transition surfaces disposed in the upper end of the inlet body section and bordering said first flow chamber.

19. The pump of claim 15, and including an open top container to contain a liquid to be pumped, said valve body disposed in said container, a lid to enclose the open top of the container and having an aperture to receive said discharge tube, the axis of said aperture being at an angle to the axis of said second flow chamber whereby the difference in angularity between said axes prevents rotation of said discharge tube relative to the lid.

20. In a food pump for dispensing portions of a food product, a conduit having an open end, a valve body connected to said conduit and defining a generally cylindrical ball chamber, said valve body having an inlet at the lower end of said ball chamber to receive a food product, a valve ball disposed in said ball chamber and mounted to open and close said inlet, said valve body also defining a flow chamber disposed laterally of said ball chamber and said valve body having an aperture connecting said ball chamber and said flow chamber, the upper end of said flow chamber being connected to the lower end of said conduit, connecting means for removably connecting said valve body to said food conduit, and means for creating a negative pressure in said conduit to thereby lift said valve ball from said inlet and enable said food product to enter said ball chamber and then flow through said flow chamber to said conduit, subsequent application of a positive pressure to the food product in said conduit causing said valve ball to engage the inlet and cause the food product to flow from said conduit through said flow chamber to a discharge site.

21. The pump of claim 18, and including a pair of sloping transition surfaces disposed in the upper end of the valve body and bordering the upper end of said flow chamber to facilitate flow of food between said flow chamber and said conduit.

22. The pump of claim 21, and including stop means connected to said conduit and above the upper end of the ball chamber to limit upward movement of the valve ball in said ball chamber.

23. The pump of claim 20, wherein said valve body has a tubular section communicating with said inlet and extending outwardly from said inlet, an extension tube disposed in said tubular section, and sealing means for sealing the outer surface of said extension tube to said tubular section.

24. The pump of claim 23, wherein the tubular section includes a bore having an inner portion, an intermediate portion to slidably receive said extension and an outer portion, the diameter of the inner portion being less than the diameter of the intermediate portion to provide a first shoulder therebetween, the inner end of the said tube being engaged with said first shoulder, the diameter of said outer portion being greater than the diameter of said intermediate portion to provide a second shoulder therebetween, said sealing means comprising an 0-ring seated against said second shoulder and sealed to said tube.

25. The pump of claim 20, wherein the horizontal dimension of said aperture is less than the diameter of the valve ball and the aperture extends substantially the full length of said ball chamber.

26. A pump for dispensing portions of a liquid product, a valve body defining a chamber and having an inlet in said chamber and disposed to receive a liquid product, a valve disposed to open and close said inlet, a tubular member connected to the valve body and connecting means for connecting the tubular member to an end of the valve body, wherein said connecting means comprises a bayonet-type connection, including a radially extending flange disposed on the lower end of said tubular member, a plurality of circumferentially spaced first tabs extending radially outward from said flange, said end of the valve body including a plurality of circumferentially spaced inwardly facing first channels to receive said first tabs with spaces between said first channels being of sufficient circumferential dimension to receive said first tabs in a release position, said the upper end of said valve body also having a second inwardly facing channel spaced circumferentially from said first channels and disposed to receive a portion of said flange, an annular compressible seal disposed between the flange and said end of the valve body, whereby canting of said tubular member to effect engagement of said flange with said second channel and leverage applied through said tubular member will compress said seal and subsequent rotation of said tubular member will move said first tabs into a locking position with said first channels to provide a sealed connection between said tubular member and said valve body.

27. The pump of claim 26, wherein said end of the valve body has an annular groove to receive said seal and also has a surface bordering the groove and facing said flange to limit compression of said seal.

28. The food pump of claim 26, wherein the axis of said tubular member is offset from the axis of said chamber and a portion of said flange extends across the upper end of said chamber to limit upward movement of said valve.

29. A food pump comprising: pump means including a cylinder and a piston mounted for movement in said cylinder, said cylinder having an open lower end, a discharge tube, a valve body interconnecting the lower end of the cylinder and the lower end of the discharge tube, said valve body including an inlet body section defining an inlet ball chamber communicating with the lower end of said cylinder and said inlet body section having an inlet, a first valve ball disposed in said inlet ball chamber and mounted to open and close said inlet, said valve body including an outlet body section defining an outlet ball chamber communicating with the lower end of said discharge tube, said valve body also including a passage connecting said inlet ball chamber with said outlet ball chamber, a second ball valve mounted for movement in said outlet valve chamber and disposed to open and close said passage, first bayonet connection means interconnecting the upper end of said inlet body section to the lower end of said cylinder, and second bayonet connection means interconnecting the upper end of said outlet body section to the lower end of said discharge tube, a radially extending flange on the lower end of said cylinder, said first bayonet connection means connecting said flange to said inlet body section, the axis of said cylinder being offset from the axis of said inlet ball chamber and a portion of said flange extending across the upper end of said inlet ball chamber to limit upward movement of said first ball valve.

30. A pump for dispensing portions of a liquid product, a valve body defining a chamber having an open upper end and having an inlet disposed to receive a liquid product, a valve located in said chamber and disposed to open and close said inlet, and a tubular member connected to the valve body and having a lower end communicating with the open upper end of said chamber, an eccentric radial flange on the lower end of the tubular member, the axis of said tubular member being offset from the axis of said chamber and a portion of said flange extending across the upper end of said chamber to limit upward movement of said valve, and bayonet connecting means for connecting the flange to said valve body.

31. The food pump of claim 30, wherein said bayonet connecting means comprises a plurality of circumferentially spaced first tabs extending radially outward from the periphery of said flange, the upper end of said valve body including a pair of circumferentially spaced inwardly facing channels to receive said first tabs with spaces between said first channels being of sufficient circumferential dimension to receive said first tabs in a release position, the upper end of said body also having a second inwardly facing channel spaced circumferentially from said first channels and disposed to receive a portion of said flange, and an annular compressible seal disposed between the flange and the upper end of said valve body, whereby canting of said tubular member to effect engagement of said flange with said second channel and downward leverage applied to said tubular member will compress said seal and subsequent rotation of said tubular member will move said first tabs into a retaining position with said first channels to provide a sealed connection between said tubular member and said valve body.

32. The pump of claim 31, wherein one end of each first channel is provided with a stop to be engaged by the respective first tab to thereby limit rotation of the tubular member and provide positive angular relationship between the tubular member and the valve body.

* * * * *

UNITED STATES PATENT AND TRADEMARK OFFICE

CERTIFICATE OF CORRECTION

PATENT NO. : 5,375,746

DATED : December 27, 1994

INVENTOR(S) : Robert E. Schaefer et al

It is certified that error appears in the above-indentified patent and that said Letters Patent is hereby corrected as shown below:

Col. 10, Lines 58-59, Cancel "the upper"

Signed and Sealed this

Twenty-third Day of May, 1995

*Attest:*

Bruce Lehman

BRUCE LEHMAN

*Attesting Officer*

*Commissioner of Patents and Trademarks*